US005383398A

United States Patent [19]

Binnen

[11] Patent Number: 5,383,398

[45] Date of Patent: Jan. 24, 1995

[54] MULTIPLE-COLOR TAMPON PRINTING MACHINE

[76] Inventor: Georg Binnen, Wiesäcker 4, D-7104 Obersulm 1, Germany

[21] Appl. No.: 980,634

[22] Filed: Nov. 24, 1992

[30] Foreign Application Priority Data

Nov. 25, 1991 [DE] Germany ..... 9114645[U]
Nov. 5, 1992 [DE] Germany ..... 9215067[U]

[51] Int. Cl.[6] ..... B41F 17/00; B41K 3/54

[52] U.S. Cl. ..... 101/41; 101/163; 101/169; 101/389.1; 101/151

[58] Field of Search ..... 101/35, 41, 44, 115, 101/163-167, 169, 170, 150, 151, 154, 155, 157, 389.1, DIG. 34, DIG. 36

[56] References Cited

U.S. PATENT DOCUMENTS

| | | | |
|---|---|---|---|
| 3,868,902 | 3/1975 | Bredshaw et al. | 101/163 |
| 3,916,784 | 11/1975 | Dubuit | 101/163 |
| 4,144,108 | 3/1979 | Gidley et al. | 101/389.1 |
| 4,557,195 | 12/1985 | Phlipp | 101/163 |
| 4,905,594 | 3/1990 | Phillip et al. | 101/163 |
| 5,095,817 | 3/1992 | Takamura | 101/163 |

FOREIGN PATENT DOCUMENTS

| | | | |
|---|---|---|---|
| 0195378B1 | 9/1986 | European Pat. Off. . | |
| 1077678 | 9/1958 | Germany | 101/44 |
| 202856 | 11/1984 | Japan | 101/163 |
| 2171645 | 9/1986 | United Kingdom | 101/163 |
| 210877 | 4/1968 | U.S.S.R. | 101/44 |

*Primary Examiner*—J. Reed Fisher
*Assistant Examiner*—Stephen R. Funk
*Attorney, Agent, or Firm*—Friedrich Kueffner

[57] ABSTRACT

A multiple-color tampon printing machine with a tampon carrier member is rotatable in a step-by-step movement about a first axis. A stereotype plate carrier member is rotatably mounted about a second axis which extends parallel to the first axis. The stereotype plate carrier member carries out a step-by-step rotating movement synchronously with the tampon carrier member. The tampon carrier member additionally carries out an up-and-down movement at predetermined fixed positions of rotation. A surface of a stereotype plate, a printing material holding device, and a tampon cleaning device are arranged in a common plane and in a circle around the tampon carrier member, such that, when the printing material is held stationary, a first tampon picks up a printing image from the respective stereotype plate surface, a second tampon preceding the first tampon prints the printing image onto the printing material, and a third tampon following the first tampon is cleaned by the tampon cleaning device. This procedure is carried out cyclically until all tampons have transferred the respective printing image to the printing material. A cyclically operating stereotype plate inking device applies printing ink on each stereotype plate prior to the transfer of the printing image by the respective tampon.

23 Claims, 3 Drawing Sheets

MULTIPLE-COLOR TAMPON PRINTING MACHINE

BACKGROUND OF THE INVENTION

1. Field of the Invention

The present invention relates to a multiple-color tampon printing machine with a tampon carrier member which is rotatable in a step-by-step movement about a first axis. The tampon carrier member supports a plurality of tampons. A carrier member for stereotype plates or bodies is rotatably mounted about a second axis which extends parallel to the first axis. A plurality of stereotype plates are mounted on the stereotype plate carrier member. The stereotype plate carrier member carries out a step-by-step rotating movement synchronously with the tampon carrier member. In addition to the step-by-step rotating movement, the tampon carrier member carries out an up and down lifting movement at predetermined fixed positions of rotation.

2. Description of the Related Art

DE-A-O 195 378 already discloses a single-color tampon printing machine which is equipped with a tampon carrier member which supports several tampons and is rotatable step-by-step about a first axis, and a stereotype plate carrier member which is rotatable about a second axis which extends parallel to the first axis. The stereotype plate carrier member supports several stereotype plates and carries out a step-by-step rotating movement synchronously with the tampon carrier member. In addition to the step-by-step rotating movement, the tampon carrier member carries out a downward and upward lifting movement at predetermined fixed positions of rotation. Accordingly, with the exception that it cannot operate as a multiple-color tampon printing machine, the tampon printing machine of the prior art reference is of the same type as the machine described above.

Known multiple-color tampon printing machines are composed of several single-color tampon printing machines which are arranged next to one another and include a conveying unit which serves to transport the printing material from the first printing machine to the next printing machines. This conveying unit simultaneously serves for indexing, so that the printing materials assume an exact position underneath the respective single-color tampon printing machine and an exact printing fit is achieved.

Other known multiple-color tampon printing systems have several single-color tampon printing machines which are arranged in a circle and a round shifting table placed in the middle between the printing machines, wherein the printing materials are placed on the shifting table with predetermined spacings.

The round shifting table transports the printing materials from one single-color tampon printing machine to the next and indexes the machine in the exact position. For multiple-color printing, these known multiple-color tampon printing machines require as many single-color tampon printing machines as the printed image has colors. For holding the printed material, the tampon printing system requires several printing material holding devices corresponding to the number of cycles of the system. These holding devices are frequently very complicated and must correspond to the printing accuracy. The change over of the machine from one printing material to another, particularly a printing material having a different shape, is very cumbersome and frequently even impossible. Accordingly, such multiple-color tampon printing machines are suitable predominantly for large series of printing materials of the same type.

In printing units with three axes, an ink transfer tampon is guided in a horizontal plane from the stereotype plate to the printing material, and is lowered in vertical direction in order to pick up ink from the stationary stereotype plate, wherein each stereotype plate is provided for one color. The ink transfer tampon is guided from the stereotype plate to the printing material, is lowered and, thus, the ink is printed from the tampon onto the printing material. Consequently, a multiple-color print is produced with an ink transfer tampon in the sequence of first stereotype plate to printing material, second stereotype plate to printing material, etc.

Such printing units having three axes are very complicated and are suitable only to a limited extent for small printing materials.

SUMMARY OF THE INVENTION

Therefore, it is the object of the present invention to provide a multiple-color tampon printing system which is capable of printing several colors on a stationary printing material with one printing mechanism.

In accordance with the present invention, the stereotype plate surface on the stereotype plate carrier member, a printing material holding device and a tampon cleaning device are arranged in a plane and in a circle around the tampon carrier member in such a way that, when the printing material is held stationary, a first tampon picks up the printing image from the respective stereotype plate which has been inked, a second tampon preceding the first tampon prints its printing image onto the printing material and a third tampon following the first tampon is cleaned by the tampon cleaning device, wherein this procedure takes place cyclically until all tampons have transferred the respective printing image onto the printing material, and wherein a cyclically operating stereotype plate inking device is provided which applies the respective printing ink on each stereotype plate prior to the transfer of the printing image by the respective tampon.

The multiple-color tampon printing machine according to the present invention ensures that the ink of each color is transferred from the stereotype plate to each ink transfer tampon during the cyclical rotation of the tampon carrier member. As a result, the multiple-color tampon printing machine according to the present invention has the advantage that it is of simple and compact construction.

In accordance with a preferred feature of the present invention, the inking device includes a number of ink containers, wherein the number of ink containers corresponds to the number of colors and an ink container is provided for each stereotype plate. Each ink container is bell-shaped and is open toward the surface of the stereotype plate. At the stereotype plate surface, each ink container has a wiper-like edge. Each ink container further includes a guide mechanism which controls the ink container so that it carries out a back and forth movement on the stereotype plate surface and, thus, cyclically applies ink to the stereotype plate surface and releases the stereotype plate surface before the transfer of the printing image by the tampons.

Accordingly, the different colors are not applied to the stereotype plate surfaces by means of ink nozzles.

Rather, an ink container which contains a certain amount of ink and which is open in the manner of a bell toward the stereotype plate surface and has a wiper-like edge is guided in a cyclical movement on the respective stereotype plate, in order to apply ink to the stereotype plate and simultaneously remove excess printing ink from the stereotype plate surface by means of the wiper-like edge.

Each ink container guide mechanism preferably includes:

- a connecting rod which connects the respective ink container with the stereotype plate carrier member, wherein the ends of the connecting rod are connected in an articulated manner to the ink container and to the stereotype plate carrier member, respectively, and
- a guide rod connected with one end thereof in an articulated manner to the stereotype plate carrier member, wherein approximately the middle of the guide rod is guided in a closed guide cam which is stationary when the stereotype plate carrier member rotates and the other end of the guide rod is connected to the connecting rod through a link rod, and wherein the link rod is connected in an articulated manner to the connecting rod and to the guide rod.

The above-described rod system for guiding the ink containers is a simple and simultaneously reliable solution for carrying out the inking of the stereotype plate surface with the different inks contained in the ink containers during the cyclical rotation of the stereotype plate carrier member. The guide cam preferably is a guide groove in which the guide rod engages by means of a guide bolt slidingly guided in the groove.

It is an advantage if the printing inks are continuously mixed or agitated even when the printing machine is standing still. For this purpose, the guide cam is provided with its own drive which rotates the guide cam while the stereotype plate carrier member is stationary, so that the inks are agitated within the ink containers because the ink containers carry out their back and forth movements for inking the stereotype plate surfaces as a result of the rotation of the guide cam even though the stereotype plate carrier member is stationary.

The above-described simple rod mechanism further makes it possible to provide a simple ink container holding device which includes a plate spring for pressing the ink container against the surface of the stereotype plate and a releasable eccentric member for clamping and releasing the plate spring. As a result, it is possible by means of the ink container holding device to remove the ink containers from the stereotype plate surfaces in a simple manner and to replace the ink containers.

For carrying out a fine adjustment of the position of the stereotype plates, a preferred feature of the present invention provides positioning each stereotype plate on an adjustable plate carriage which is constructed in the manner of a cross slide.

Of course, each individual imprint of the multiple-color print must be carried out in the accurate position relative to the other imprints. In order to be able to adjust this position exactly, each plate carriage has longitudinal guide rails for the longitudinal guidance of a moveable carriage portion, permanent magnets for holding moveable carriage portion in the exact position and an adjusting screw for adjusting the moveable carriage portion in the longitudinal direction thereof.

The stereotype plates are preferably of magnetizable material or have a bottom layer of magnetizable metal. The permanent magnets of the plate carriages simultaneously serve to hold the stereotype plates on the plate carriages.

In order to facilitate setting up of the machine, a lifting cam having four portions provided for controlling the up and downward movement of the tampon carrier member is provided with a freewheel, wherein the freewheel takes along the lifting cam during the normal printing operation in order to carry out a continuous upward and downward and rotating operation of the tampon carrier member, while the freewheel releases the tampon carrier member during the backward rotation, so that the lifting cam stops and the tampon carrier member is rotated backward without lifting movement, and the tampons do not touch the printing material or the stereotype plates.

Other objects and features of the present invention will become apparent from the following detailed description considered in conjunction with the accompanying drawing. It is to be understood, however, that the drawing is designed solely for purposes of illustration and not as a definition of the limits of the invention, for which reference should be made to the appended claims.

DESCRIPTION OF THE PREFERRED EMBODIMENT

Figure 1:
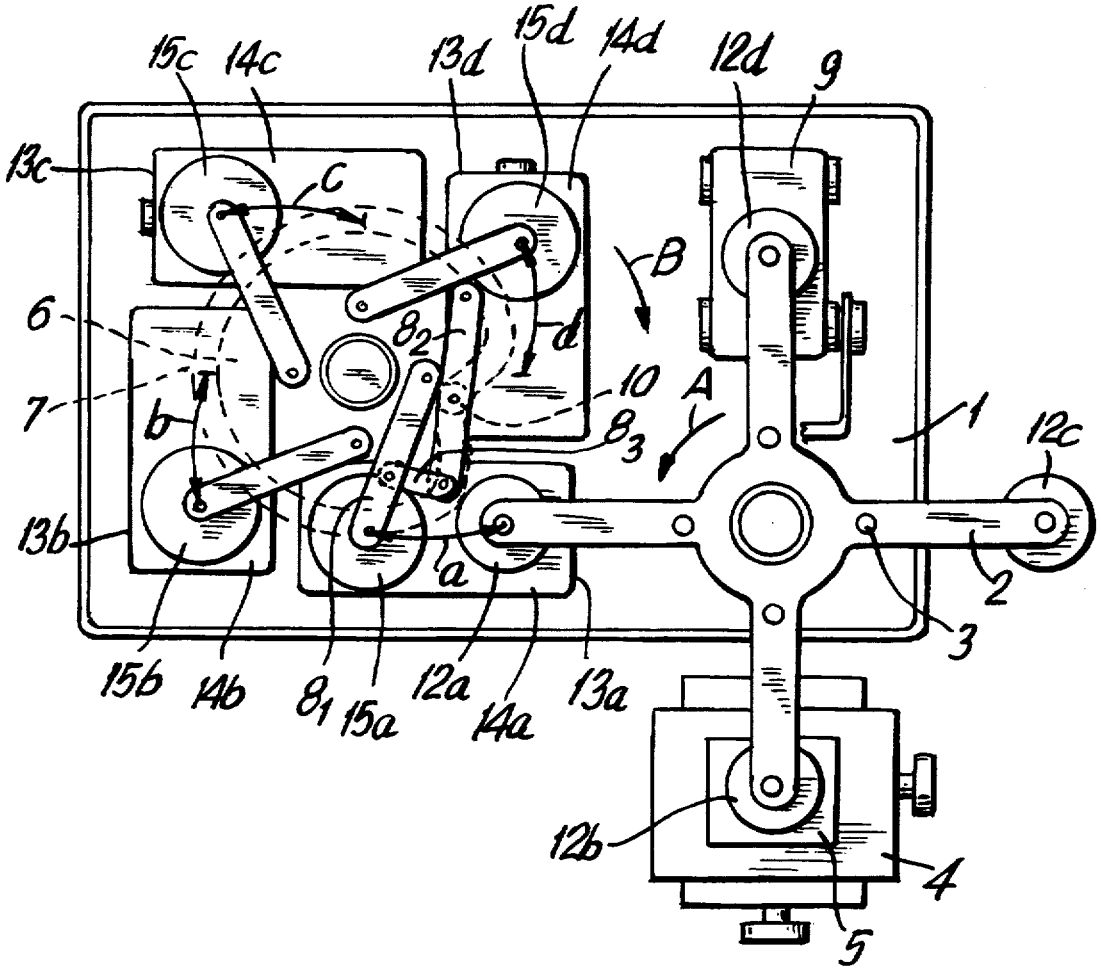
FIG. 1 is a schematic top view of a preferred embodiment of the multiple-color tampon printing machine according to the present invention.

FIG. 1 of the drawing shows the essential components of the preferred embodiment of the multiple-color tampon printing machine according to the present invention. On a machine frame 1 is mounted a tampon carrier member 2 which is rotatable about an axis which, as shown in the drawing, extends perpendicularly relative to the plane of FIG. 1. In the illustrated embodiment, the tampon carrier member 2 has four support arms arranged in a star-like configuration. Mounted at the ends of the support arms are four suspended printing tampons 12*a*, 12*b*, 12*c*, 12*d*. Each printing tampon is assigned to a specific printing color.

Figure 4:
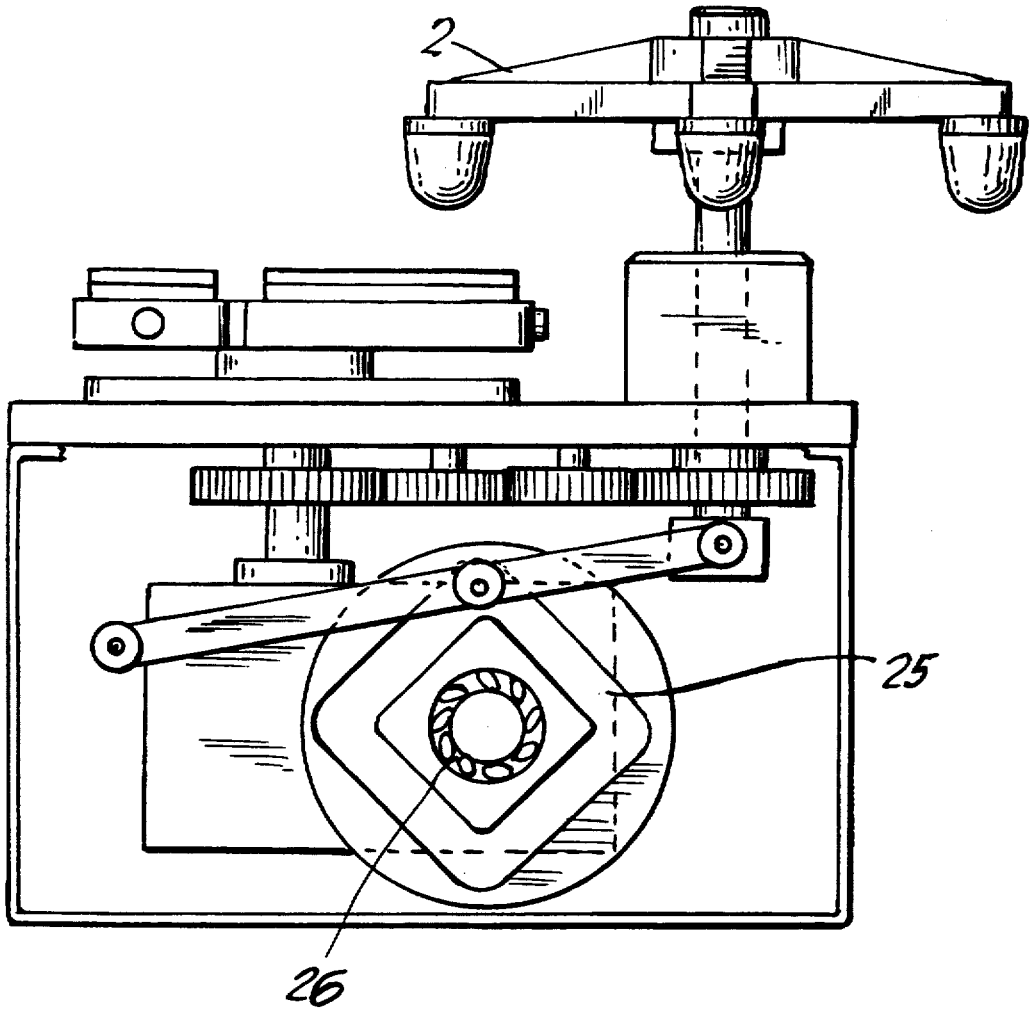
FIG. 4 is a sectional view of the tampon printing machine of FIG. 1.

The tampon carrier member 2 is rotated in the direction of arrow A about the vertical axis in a step-by-step rotation. Simultaneously, the tampon carrier member 2 is subjected to a downward and upward lifting motion. For this purpose, as shown in detail in FIG. 4, a lifting cam 25 is provided, which is connected through a freewheel 26 to the shaft carrying the tampon carrier member 2. In the illustrated embodiment, the lifting cam 25 is divided into four portions. The freewheel 26, serves to carry out the desired downward and upward lifting motion during the rotation of the tampon carrier member 2 in the direction of arrow A shown in FIG. 1 and to carry along the lifting cam 25. When the tampon carrier member 2 is rotated in the opposite direction, i.e., opposite the direction of arrow A in FIG. 1, the lifting cam 25 is released and the lifting cam 25 stops, so that the tampon carrier member 2 rotates without the lifting motion. The printing machine can be set up during this time.

A cross slide 4 with printing material 5 fastened thereon, the stereotype plates 14*a* to 14*d* and a tampon cleaning device 9 are arranged underneath the support arms of the tampon carrier member 2. The cross slide 4, the stereotype plates as well as the tampon cleaning device 9 are arranged offset relative to each other by 90° and in a plane, so that, during the step-by-step rotation and simultaneous lifting motion of the tampon carrier member 2, each printing tampon carries out in a cyclical sequence the steps of picking up ink from the surface of the stereotype plate, transferring the ink to the printing material 5 and, after passing a vacant position, removing residual ink from the tampon by means of the tampon cleaning device 9. In order to ensure that the printing tampons exactly reach the above-mentioned common plane during the downward movement of the tampon carrier member 2, this downward movement of the tampon carrier member 2 is precisely positioned by means of four indexing pins 3.

A stereotype plate carrier member 6 rotates synchronously with the tampon carrier member 2 in the direction of arrow B about an axis which extends parallel to the axis of the tampon carrier member 2. The plate carrier member 6 carries out a step-by-step rotation following the step-by-step rotation of the tampon carrier member 2, so that each stereotype plate 14*a*, 14*b*, 14*c*, 14*d* to which ink has been applied is placed opposite the corresponding printing tampon 12*a*, 12*b*, 12*c*, 12*d* and, after the tampon carrier member 2 has been moved downwardly, the respective printing tampon can pick up the printing ink from the stereotype plate.

Figure 2:
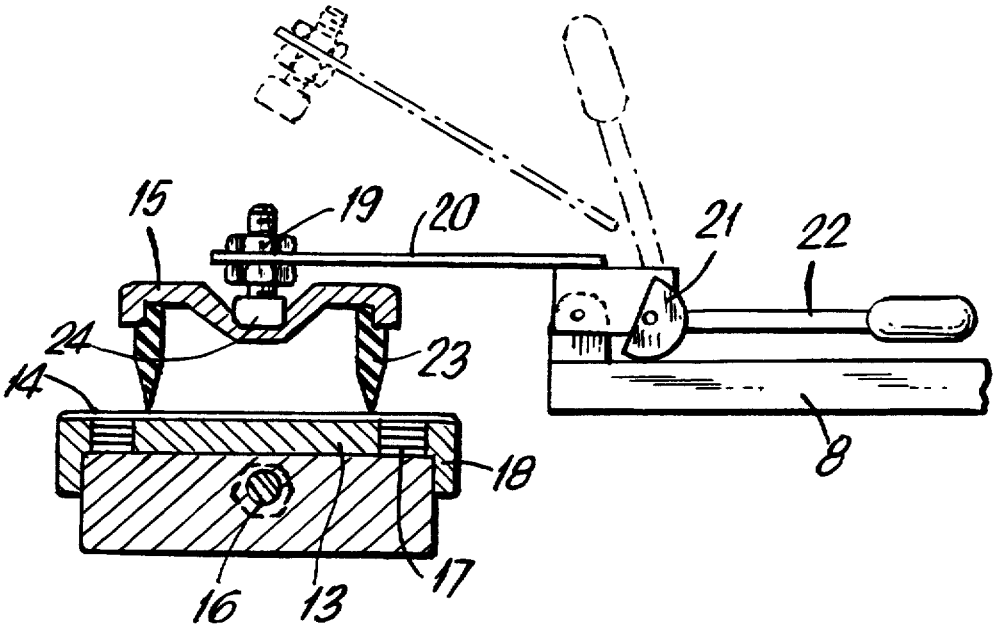
FIG. 2 is a schematic view, partly in section, of an ink container holding device.

The printing ink is transferred to the surface of each stereotype plate by means of an ink container which is illustrated in detail in FIG. 2. The application of ink occurs when the stereotype plates are in positions in which the respective printing tampon does not pick up ink from the stereotype plate, i.e. in the positions assumed in FIG. 1 by the stereotype plates 14*b*, 14*c* and 14*d*. For applying the printing ink to the stereotype plate surfaces, the ink containers 15*a*, 15*b*, 15*c*, 15*d* are moved by means of rod linkages which act on the center of the upper side of the ink containers. Each rod linkage is composed of a connecting rod $8_1$, a guide rod $8_2$, a link rod $8_3$ and a guide cam 7 which is stationary during normal operation. The guide cam 7 is constructed as a groove and the guide rod $8_2$ is guided in the guide cam 7 by means of a guide roller 10. The guide rod $8_2$ is pivotally connected with one end to the rotating plate carrier member 6 and is connected in an articulated manner with its other end to the link rod $8_3$. The other end of the link rod $8_3$ is pivotally connected to the connecting rod $8_1$ which, in turn, is with its one end pivotally connected to the plate carrier member 6 and with its other end to the respective ink container.

As a result of the above-described configuration, the ink containers 15*a*, 15*b*, 15*c*, 15*d* carry out on the surfaces of the stereotype plates a backward and forward movement, which is indicated in the drawing by double arrows a, b, c, d, during the normal rotating movement of the plate carrier member 6, so that, in the ink transfer position, i.e. the position assumed by stereotype plate 14*a* in FIG. 1, the ink container 15*a* moves away from the stereotype plate surface and, in the other positions, the ink containers apply ink to the stereotype plate surfaces.

The guide cam 7 is driven by its own drive, not shown, which ensures that the guide cam 7 can be rotated when the plate carrier member 6 is stationary. This causes a back and forth movement of the ink containers 15*a*, 15*b*, 15*c*, 15*d* in the directions of double arrows a, b, c, d, so that the ink in the ink containers is agitated and ink is applied simultaneously to the stereotype plate surfaces.

Of course, although FIG. 1 shows a rod linkage $8_1$, $8_2$, $8_3$ acting on only the ink container 15*a* in order to simplify the illustration, each ink container is guided by the guide cam 7 by means of an equivalent rod linkage.

Figure 3:
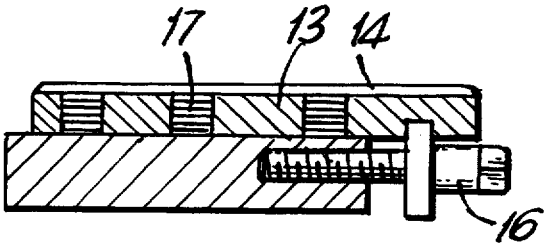
FIG. 3 is a sectional view of a stereotype plate carriage with a stereotype plate fastened thereon.

In the case of the tampon carrier member 2, the respective position of rotation which in FIG. 1 is obtained by the cyclical rotation of the tampon carrier member 2 by always 90°, as well as the lower position of the tampon carrier member 2 are fixed by the indexing pins 3. In the case of the plate carrier member 6, on the other hand, it is required that the positions of the individual stereotype plates can be adjusted precisely. For this purpose, as shown in FIGS. 2 and 3, each stereotype plate 14 is mounted on the upper side of a plate carriage 13 which is displaceable in the manner of a cross slide. By turning a positioning screw 16, a linear displacement of the plate carriage is possible. Guide rails 18 are provided for this purpose. Permanent magnets 17 are mounted in the upper displaceable portion of each plate carriage 13. The permanent magnets 17 serve to hold the stereotype plates 14 to the surface and to hold the moveable upper portion of the plate carriage 13 in the fixed adjusted position. To make this possible, the stereotype plates 14 either are entirely of magnetizable material or magnetic metal or they have a layer of magnetizable material or magnetic metal.

FIG. 2 of the drawing is a schematic sectional view of an ink container 15 on a stereotype plate 14 and shows that the ink container 15 is open toward the surface of the stereotype plate and has a wiper-like edge 23 at the surface of the stereotype plate. The wiper-like edge 23 is preferably of a flexible material, for example, synthetic material, rubber material or the like.

FIG. 2 of the drawing further shows a device for pressing the ink container against the stereotype plate. The pressing device is fastened on the respective connecting rod 8 and includes a plate spring 20 which a head 24 fastened at one end thereof against the upper side of the ink container 15. The pressure applied by the plate spring 20 through the head 24 on the ink container 15 can be adjusted by means of an adjusting screw 19. The pressure device further includes a hand lever 22 for tightening and releasing the plate spring 20 and additionally has an eccentric member 21. FIG. 2 shows in dash-dot lines a position of the hand lever 22 and the plate spring 20 with the head 24 in which the ink container 15 is released. In this position, the ink container 15 can be removed and, for example, cleaned and filled with new ink.

The drawing does not show the drive of the shaft of the tampon carrier member 2. Preferably used for this purpose are a stepping gear system and a stepping motor, not shown. The required synchronized rotation between the drive shafts of the tampon carrier member 2 and the stereotype plate carrier member 6 is ensured by meshing gear wheels, not shown, mounted on the shafts.

In the preferred embodiment described above, the tampon carrier member 2 has four support arms which project radially in a star-like configuration and on the underside of which the tampons 12 are fastened in a suspended manner.

However, in accordance with another embodiment, the tampon carrier member can also be equipped with an essentially circular support plate instead of the individual support arms.

Also, in accordance with another embodiment, the ink container guidance effected by the rods $8_1$, $8_2$ and $8_3$ which are connected to each other in an articulated manner together with the guide cam 7 and the guide bolt 10 can instead be realized by an electromagnetic ink container adjustment means which may at least partially be integrated in the stereotype plate carriage.

It should be understood that the preferred embodiments and examples described are for illustrative purposes only and are not to be construed as limiting the scope of the present invention which is properly delineated only in the appended claims.

What is claimed is:

1. A multiple-color tampon printing machine comprising a tampon carrier member supporting a plurality of tampons, means for moving the tampon carrier member in a step-by-step rotating movement about a first axis, a stereotype plate carrier member being rotatably mounted about a second axis which extends parallel to the first axis, a plurality of stereotype plates being mounted on the stereotype plate carrier member, each stereotype plate having a surface, further comprising means for cyclically moving the stereotype plate carrier member in a step-by-step rotating movement synchronously with the tampon carrier member, wherein the stereotype plate surface of one of the stereotype plate carrier members, a printing material holding device, and a tampon cleaning device are mounted in a common plane and in a circle around the tampon carrier member at predetermined locations relative to the tampon carrier member, means for raising and lowering the tampon carrier member at predetermined fixed positions of rotation corresponding to the locations of the stereotype plate surface, the tampon printing machine further comprising a cyclically operating inking device for applying printing ink on the surfaces of the stereotype plates, such that, with the printing material being held stationary, during each step of the rotating movement of the tampon carrier member, a first of the tampons picks up a printing image from the one of the stereotype plates after having been inked by the inking device, a second of the tampons preceding the first tampon prints a printing image onto the printing material, and a third of the tampons following the first tampon is cleaned by the tampon-cleaning device until all tampons have printed a printing image on the printing material, wherein the inking device comprises a plurality of ink containers, the number of ink containers corresponding to the number of stereotype plates, each ink container being bell-shaped and open toward the surface of the stereotype plate, each ink container having at the stereotype plate surface a wiping edge, each ink container further comprising a guide mechanism for moving the ink container back and forth on the stereotype plate surface for cyclically applying ink to the stereotype plate surface and for moving the ink container away from the stereotype plate surface before one of the tampons picks up the printing image.

2. The multiple-color tampon printing machine according to claim 1, wherein the guide mechanism comprises a connecting rod connecting the ink container with the stereotype plate carrier member, the connecting rod having ends, one of the ends of the connecting rod being connected in an articulated manner to the ink container and another end of the connecting rod being connected to the stereotype plate carrier member, a guide rod having first and second ends, the first end of the guide rod being connected in an articulated manner to the stereotype plate carrier member, the tampon printing machine further comprising a closed guide cam, the guide rod having a middle, approximately the middle of the guide rod being guided in the closed guide cam which is mounted so as to be stationary when the stereotype plate carrier is rotated, and a link rod connected in an articulated manner to the second end of the guide rod and to the connecting rod.

3. The multiple-color tampon printing machine according to claim 2, wherein the guide cam comprises a guide groove, the guide bolt attached thereto, the guide bolt of the guide rod being slidingly guided in the guide groove.

4. The multiple-color tampon printing machine according to claim 3, wherein the guide cam comprises a separate drive for rotating the guide cam when the stereotype plate carrier member is stationary, whereby mixing of ink within the ink containers is carried out.

5. The multiple-color tampon printing machine according to claim 1, wherein the inking device further comprises an ink container holding device, the ink container holding device comprising a plate spring for pressing the wiping edge of each ink container against the surface of the stereotype plate and a releasable eccentric member for clamping and releasing the plate spring.

6. The multiple-color tampon printing machine according to claim 1, wherein the stereotype plate carrier member comprises stereotype plate carriages for supporting the stereotype plates.

7. The multiple-color tampon printing machine according to claim 6, wherein each stereotype plate carriage comprises a movable carriage portion and longitudinal guide rails for longitudinally guiding the movable carriage portion, permanent magnets for holding the movable carriage portion in an accurately defined position, and an adjusting screw for adjusting the movable carriage portion in the longitudinal direction.

8. The multiple-color tampon printing machine according to claim 7, wherein the stereotype plates are of magnetizable material, and wherein the permanent magnets are mounted for holding the stereotype plates.

9. The multiple-color tampon printing machine according to claim 1, comprising a lifting cam for carrying out the upward and downward movement of the tampon carrier member, the lifting cam comprising four portions equally spaced from each other, and a freewheel for rotating the lifting cam when the tampon carrier member rotates in a first direction, and for releasing the tampon carrier member when the tampon carrier is rotated in a second direction, so that the lifting cam becomes stationary and the tampon carrier member is rotated in the second direction without lifting motion.

10. The multiple-color tampon printing machine according to claim 1, wherein the tampon carrier member and the stereotype plate carrier member have the same number of tampons and stereotype plates, respectively.

11. The multiple-color tampon printing machine according to claim 10, wherein the tampon carrier member and the stereotype plate carrier member each have at least three tampons and stereotype plates, respectively.

12. A multiple-color tampon printing machine comprising a tampon carrier member supporting a plurality of tampons, means for moving the tampon carrier member in a step-by-step rotating movement about a first axis, a stereotype plate carrier member being rotatably mounted about a second axis which extends parallel to the first axis, a plurality of stereotype plates being mounted on the stereotype plate carrier member, each stereotype plate having a surface, further comprising means for cyclically moving the stereotype plate carrier member in a step-by-step rotating movement synchronously with the tampon carrier member, wherein the stereotype plate surface of one of the stereotype plate carrier members, a printing material holding device, and a tampon cleaning device are mounted in a common plate and a circle around the tampon carrier member at predetermined locations relative to the tampon carrier member, means for raising and lowering the tampon carrier member at predetermined fixed positions of rotation corresponding to the locations of the stereotype plate surface, the tampon printing machine further comprising a cyclically operating inking device with a plurality of ink containers, the number of ink containers corresponding to the number of stereotype plates, for applying printing ink on the surfaces of the stereotype plates, such that, with the printing material being held stationary, during each step of the rotating movement of the tampon carrier member, a first of the tampons picks up a printing image from the one of the stereotype plates after having been inked by the inking device, a second of the tampons preceding the first tampon prints a printing image onto the printing material, and a third of the tampons following the first tampon is cleaned by the tampon-cleaning device until all tampons have printed a printing image on the printing material.

13. The multiple-color tampon printing machine according to claim 12, wherein each ink container is bell-shaped and open toward the surface of the stereotype plate, each ink container having at the stereotype plate surface a wiping edge, each ink container further comprising a guide mechanism for moving the ink container back and forth on the stereotype plate surface for cyclically applying ink to the stereotype plate surface and for moving the ink container away from the stereotype plate surface before one of the tampons picks up the printing image.

14. The multiple-color tampon printing machine according to claim 13, wherein the guide mechanism comprises a connecting rod connecting the ink container with the stereotype plate carrier member, the connecting rod having ends, one of the ends of the connecting rod being connected in an articulated manner to the ink container and another end of the connecting rod being connected to the stereotype plate carrier member, a guide rod having first and second ends, the first end of the guide rod being connected in an articulated manner to the stereotype plate carrier member, the tampon printing machine further comprising a closed guide cam, the guide rod having a middle, approximately the middle of the guide rod being guided in the closed guide cam which is mounted so as to be stationary when the stereotype plate carrier is rotated, and a link rod connected in an articulated manner to the second end of the guide rod and to the connecting rod.

15. The multiple-color tampon printing machine according to claim 14, wherein the guide cam comprises a guide groove, the guide rod having a guide bolt attached thereto, the guide bolt of the guide rod being slidingly guided in the guide groove.

16. The multiple-color tampon printing machine according to claim 15, wherein the guide cam comprises a separate drive for rotating the guide cam when the stereotype plate carrier member is stationary, whereby mixing of ink within the ink containers is carried out.

17. The multiple-color tampon printing machine according to claim 13, wherein the inking device further comprises an ink container holding device, the ink container holding device comprising a plate spring for pressing the wiping edge of each ink container against the surface of the stereotype plate and a releasable eccentric member for clamping and releasing the plate spring.

18. The multiple-color tampon printing machine according to claim 12, wherein the stereotype plate carrier member comprises stereotype plate carriages for supporting the stereotype plates.

19. The multiple-color tampon printing machine according to claim 18, wherein each stereotype plate carriage comprises a movable carriage portion and longitudinal guide rails for longitudinally guiding the movable carriage portion, permanent magnets for holding the movable carriage portion in an accurately defined position, and an adjusting screw for adjusting the movable carriage portion in the longitudinal direction.

20. The multiple-color tampon printing machine according to claim 19, wherein the stereotype plates are of magnetizable material, and wherein the permanent magnets are mounted for holding the stereotype plates.

21. The multiple-color tampon printing machine according to claim 12, comprising a lifting cam for carrying out the upward and downward movement of the tampon carrier member, the lifting cam comprising four portions equally spaced from each other, and a freewheel for rotating the lifting cam when the tampon carrier member rotates in a first direction, and for releasing the tampon carrier member when the tampon carrier is rotated in a second direction, so that the lifting cam becomes stationary and the tampon carrier member is rotated in the second direction without lifting motion.

22. The multiple-color tampon printing machine according to claim 12, wherein the tampon carrier member and the stereotype plate carrier member have the same number of tampons and stereotype plates, respectively.

23. The multiple-color tampon printing machine according to claim 12, wherein the tampon carrier member and the stereotype plate carrier member each have at least three tampons and stereotype plates, respectively.

* * * * *